United States Patent [19]

Bontemps

[11] Patent Number: 4,960,063

[45] Date of Patent: Oct. 2, 1990

[54] SAFETY DEVICE FOR THE FOOT-HOLDER OF A SAIL BOARD OR THE LIKE

[75] Inventor: Daniel Bontemps, Nevers, France

[73] Assignee: STE Look, Nevers, France

[21] Appl. No.: 229,468

[22] Filed: Aug. 8, 1988

[30] Foreign Application Priority Data

Aug. 28, 1987 [FR] France ..... 87 12067

[51] Int. Cl.[5] ..... B63H 9/04

[52] U.S. Cl. ..... 114/39.2; 24/602; 441/70; 441/75

[58] Field of Search ..... 114/39.2; 441/70, 75; 24/602

[56] References Cited

U.S. PATENT DOCUMENTS

| | | | |
|---|---|---|---|
| 4,075,741 | 2/1978 | Barbal | 24/602 |
| 4,367,570 | 1/1982 | Barbal | 24/602 |
| 4,466,373 | 8/1984 | Prade et al. | 114/39.2 |
| 4,528,924 | 7/1985 | Marker et al. | 114/39.2 |
| 4,693,199 | 9/1987 | Omachen et al. | 114/39.2 |

FOREIGN PATENT DOCUMENTS

| | | | |
|---|---|---|---|
| 0074087 | 3/1983 | European Pat. Off. | 441/70 |
| 3128661 | 2/1983 | Fed. Rep. of Germany | 114/270 |
| 3415021 | 10/1984 | Fed. Rep. of Germany | 441/75 |

*Primary Examiner*—Sherman Basinger
*Assistant Examiner*—Thomas J. Brahan
*Attorney, Agent, or Firm*—Young & Thompson

[57] ABSTRACT

A safety device for the foot-holder of a sailboard or the like in which the foot-holder has a strap in the form of a loop fixed at one end on the sailboard. The other end of the strap is secured to a latch which can be engaged in a locking body with a first elasticity in a first predetermined direction and then locked in the locking body with a second elasticity in a second direction perpendicular to the first predetermined direction. The latch and locking body are so arranged that under the action of a pulling stress exerted on the latch in the second direction, the latch is unlocked in a direction to enlarge the loop while remaining engaged in the locking body. But under the action of a shearing stress exerted on the latch in the first direction, the latch is released from the locking body and opens the hoop.

13 Claims, 3 Drawing Sheets

FIG. 3
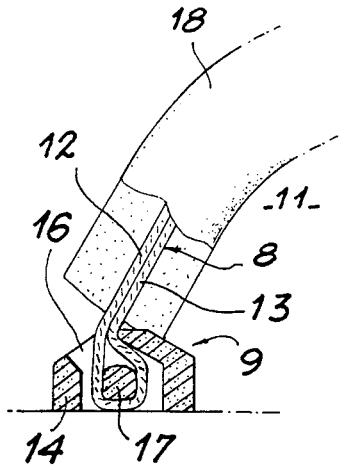
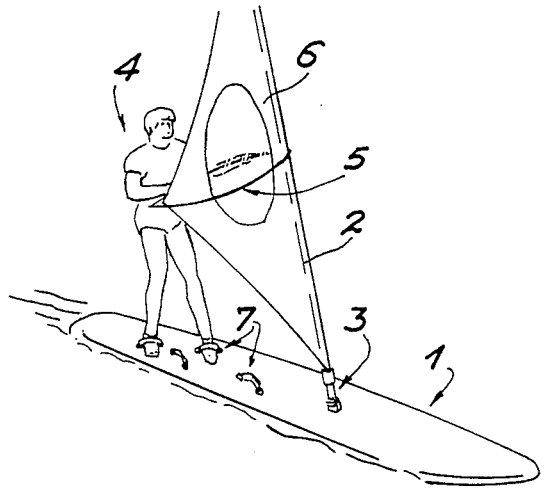
FIG. 1
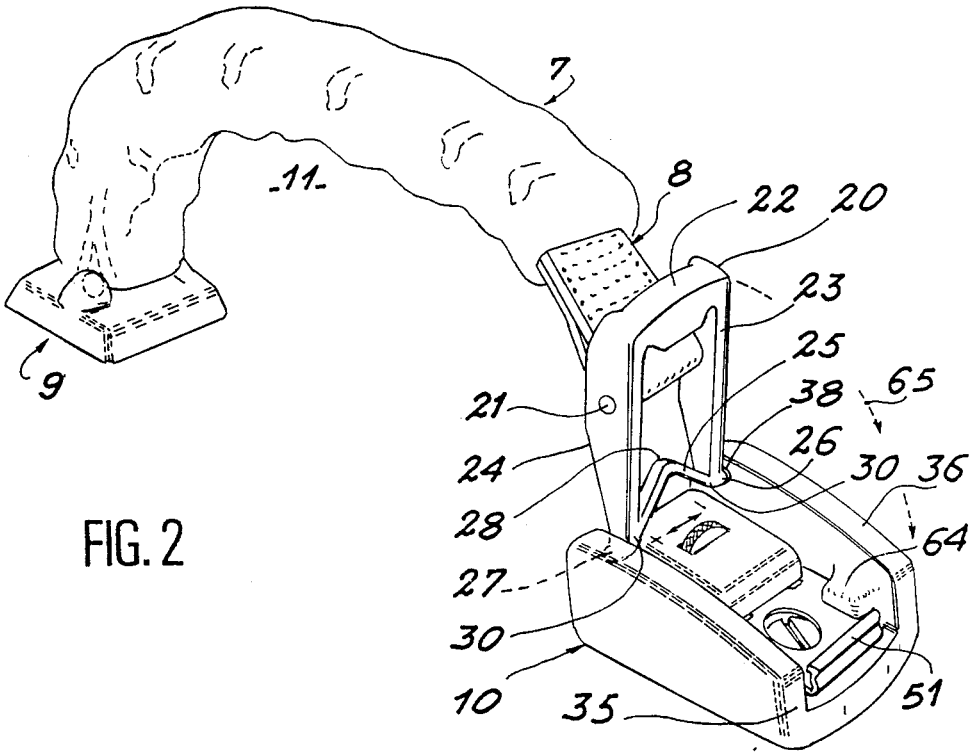
FIG. 2

FIG. 5
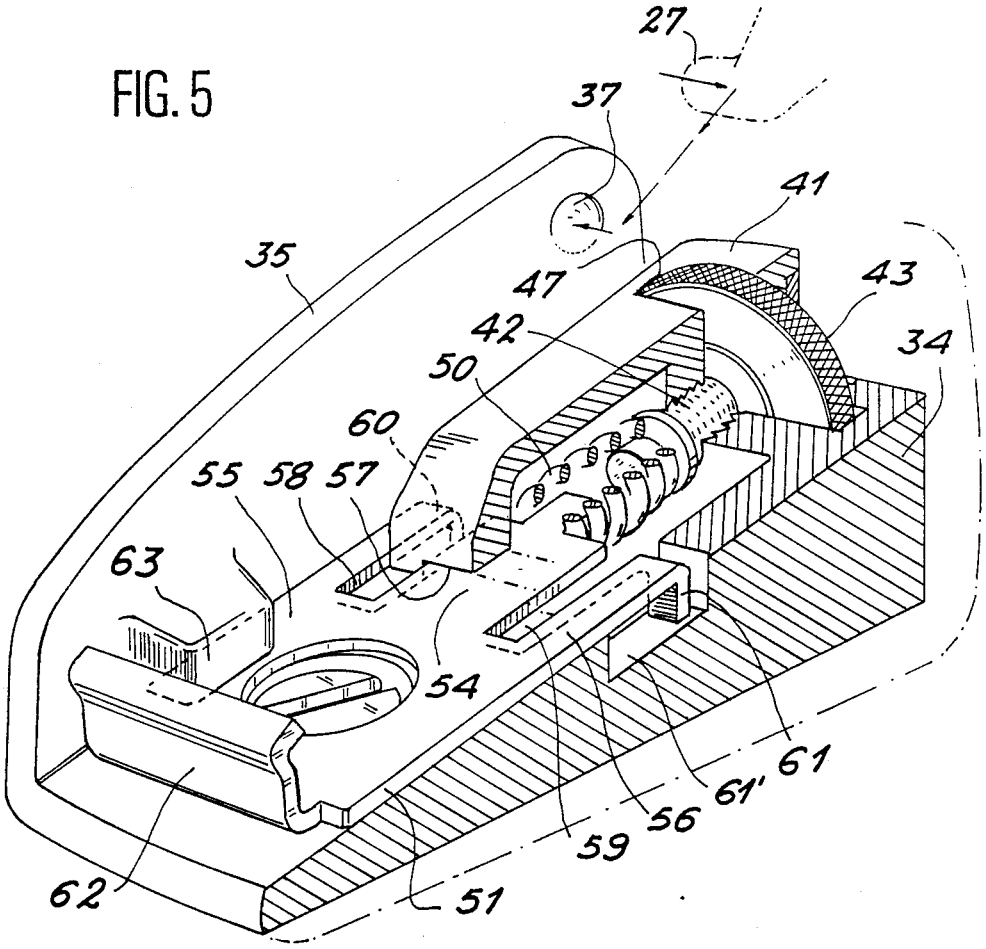
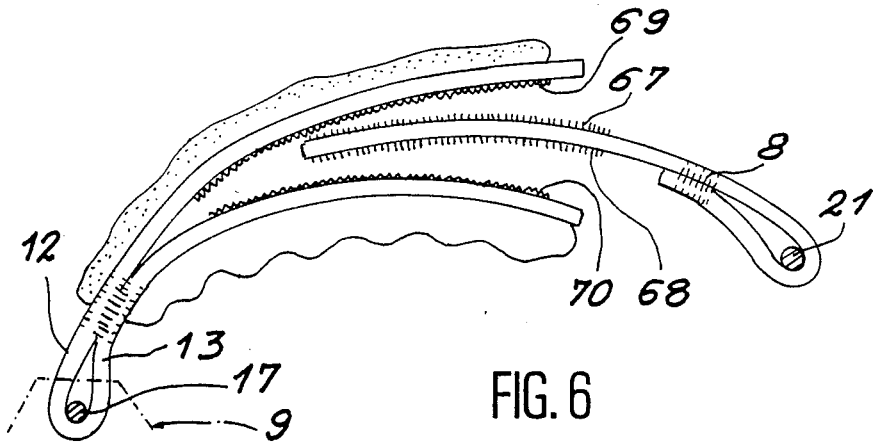
FIG. 6

SAFETY DEVICE FOR THE FOOT-HOLDER OF A SAIL BOARD OR THE LIKE

BACKGROUND OF THE INVENTION

1. Field of the Invention

The present invention relates to a foot-holder for a sailboard or similar sports device which glides or rolls on a bearing medium. The user acts on the position of an orientable mast by means of a boom or wishbone attached to the sail with his or her feet resting on the sailboard or on a shaped support as the user moves over the bearing medium and is propelled under the action of the wind on the sail.

2. Description of the Prior Art

It is known that in a device of this type, the user's body is normally placed laterally with respect to the longitudinal direction of the sailboard, thus forming a balance as his arms hold the wishbone in order to counterbalance the reaction of the wind on the sail and to ensure stability of the device while at the same time controlling the various movements of the sailboard, its increase in speed or on the contrary its braking action. During these movements, the user's feet have to be fixed on the sailboard surface for most of the time in order to ensure effective support without any attendant danger of slipping. Such an undesirable event would be liable not only to produce a disagreeable fall but even to cause an accident if such a fall were to be accompanied by abrupt twisting or flexure of the leg or foot in an orientation which is contrary to a natural movement.

In order to overcome this disadvantage, manufacturers of sailboards have long made it a practice to place on the top surface of sailboards at suitable locations flexible hoops generally known as foot-straps in which the user engages each foot. A hoop of this type forms a foot-holder and is usually constituted by a strap secured at each end to the sailboard. However, in conventional designs, if the user's feet are effectively and correctly immobilized on the sailboard during use, the more so as the strap is correctly tightened so as to leave only a limited clearance between the foot and the internal face of the strap, a risk of accident is not thereby removed and may even be increased in the event of a fall if the user cannot immediately withdraw his feet which thus remain locked in position with respect to the sailboard. This is the case in particular of acrobatic figures in which the user performs high jumps above the waves and in which there is a greater danger of falling with all its attendant consequences.

The present invention is directed to a safety device which overcomes these disadvantages by making it possible, in the event of sudden twisting or flexure of a user's feet or legs and in particular in the event of a fall, to effect instantaneous release of the foot-holder in which the user has normally engaged each foot.

SUMMARY OF THE INVENTION

The safety device in accordance with the invention, in which the foot-holder has a strap fixed at one end on the sailboard, is distinguished by the fact that the other end of the strap 8 is secured to a latch 20 which can be engaged in a locking body 10 with a first elasticity in a first predetermined direction and then locked in said locking body 10 with a second elasticity in a second direction perpendicular to the first predetermined direction, with the result that under the action of a pulling stress exerted on the latch in the second direction, said latch is unlocked while remaining engaged in the locking body and that under the action of a shearing stress exerted on the latch in the first direction, said latch is released from the locking body and opens the hoop.

The first elasticity is achieved by means of the latch which is constituted by two parallel arms connected rigidly at one end and resiliently at the other. The resilient assembly of the parallel arms makes it possible on the one hand to engage the latch in the locking body but on the other hand to disengage it from said locking body in the event of a shearing stress which has a tendency to reduce the opening of said arms. Engagement of the latch on the locking body is achieved by means of lugs carried by the ends of the parallel arms on the resilient side.

The second elasticity is obtained in the locking body by means of a sliding element, one end of said element being adapted to cooperate with a spring which works in compression whilst the other end of said element has a bearing face which is adapted to cooperate with a corresponding bearing face of the latch so as to lock said latch on the locking body. A predetermined pulling effort exerted on the hoop of the foot-holder causes a displacement of the sliding element and release of the latch with respect to the locking body by sliding of one bearing face with respect to the other.

Compression of the spring is adjustable by means of a knurled wheel which is secured against translation and adapted to cooperate with a threaded shaft which is secured against rotation, one end of said shaft being adapted to cooperate with said spring, with the result that rotation of the knurled wheel compresses the spring to a greater or lesser extent, locking and unlocking of the latch being consequently made more or less difficult.

BRIEF DESCRIPTION OF THE DRAWINGS

FIG. 1 is a perspective view of a sailboard on which the relative position of the user carried by the sailboard is shown diagrammatically.

FIG. 2 is a sectional view in perspective showing a safety foot-holder as constructed in accordance with the invention and adapted to be mounted on the sailboard of FIG. 1.

FIG. 3 is a fragmentary transverse sectional view of the loop 9 of the foot-holder of FIG. 2.

FIG. 5 is a part-sectional exploded view of the locking body in accordance with the invention.

FIG. 6 is a transverse sectional view of a particular example of construction of a hoop of adjustable length in accordance with the invention.

DETAILED DESCRIPTION OF THE INVENTION

Figure 4:
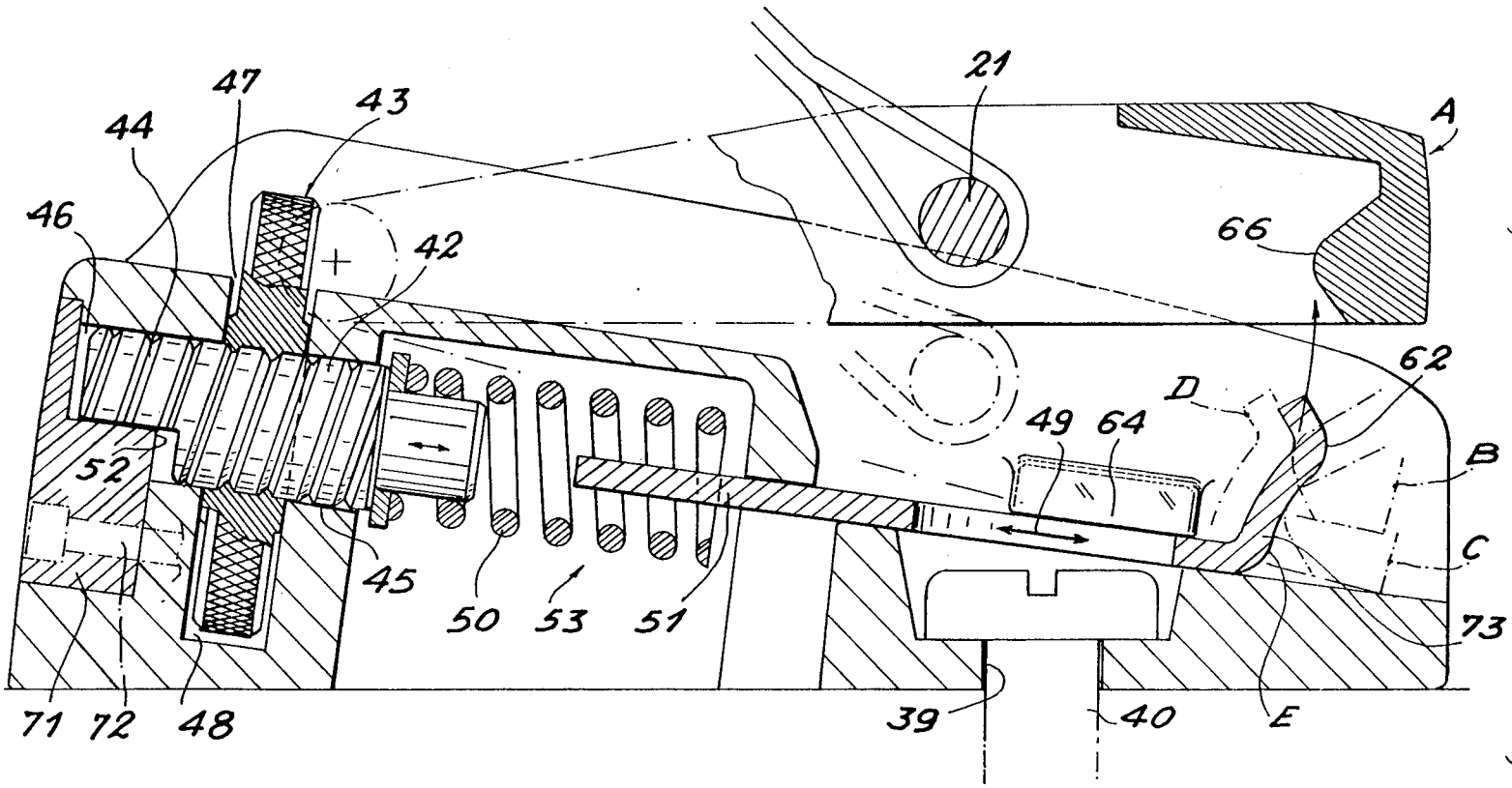
FIG. 4 is a transverse sectional view of the locking body and of the latch in accordance with the invention.

As is presented very diagrammatically in FIG. 1, a sailboard 1 comprises in well-known manner an orientable mast 2 fixed in the axis of this latter by means of a mast-end 3, thus enabling a user to incline the mast to the vertical as well as in the forward or rearward direction according to requirements in order to carry out the various movements and especially to catch the wind in the sail. To this end, the user 4 holds in his (or her) hands a boom or a wishbone 5 which is secured to the mast 2 and serves to stretch and orient a sail 6, all these arrangements being wholly conventional in the windsurfing technique. In addition, during the initial stage of operation of the sailboard, the user engages his (or her) feet within foot-holders 7 which are fixed on the top surface of the sailboard 1 with a suitable orientation in order to provide the user with a fixed support on the sailboard. This enables him (or her) to displace the weight of his (or her) body laterally in order to counterbalance the wind resistance of the sail 6 and to cause propulsion of the sailboard. It is therefore apparent that, in the event of a fall, the user runs the risk of twisting or flexure of his (her) feet or legs in a direction which may in some instances lead to an accident FIGS. 2, 3, 4 and 5 illustrate to a larger scale the constructional detail of a foot-holder 7 in accordance with the invention. This foot-holder is provided with a safety device which makes it possible in normal operation to ensure that the user's foot is securely maintained once it has been engaged in this latter. However, in the event of an abrupt torsional or flexural stress beyond a predetermined threshold value and in particular in the event of a fall, the safety device makes it possible to release the foot without any attendant danger of sprain or fracture.

As shown in these figures, the foot-holder 7 is essentially composed of an inelastic strap 8 constituted by a braided element or flat strip attached at one end to a loop 9 which is secured to the top face of the sailboard 1 and at the other end to a locking body 10. Said strap thus forms between the loop and the locking device a kind of hoop which delimits with the sailboard a space 11 in which the user engages his (her) foot in the manner explained earlier.

The strap 8 is in fact formed of two strands 12 and 13 respectively, said strands being attached to each other after being passed through the loop 9 which is in turn fixed on the sailboard 1 by construction. This loop can thus be fitted with a casing 14 provided laterally with two bores for mounting fixing screws and provided with a transverse slot 16 and a central hinge-pin 17. In the usual manner, the strand 12 of the strap first passes through the slot 16 on one side of the hinge-pin 17, then passes beneath the hinge-pin, is then extended by the strand 13 which passes out of the casing 14 through the same slot 16 but on the opposite side of the hinge-pin, thus securing the strap. The strands 12 and 13 are advantageously fastened together over the greater part of their length beyond the casing 14 by stitching or the like and are advantageously covered by a sheath 18 of plastic foam or like material, thus making it possible in the closed position of the foot-holder 7 to apply the strap against the user's foot without any attendant danger of injury.

At the opposite end of the strap 8, the strands 12 and 13 are separated from each other so as to form an eyelet which serves to fix this end of the strap on a latch 20 by means of a hinge-pin 21 carried by the latch. Said latch 20 has the general shape of the letter U having a base 22 and two side arms 23 and 24. Apart from the base 22, said two lateral arms 23 and 24 are joined to each other by means of the strap-holding hinge-pin 21 and by means of a spacer member 25 placed at the open end of the U opposite to the base 22. The arms 23 and 24 and the spacer member 25 have a certain elasticity so as to permit displacement of the ends of the arms in a direction parallel to the base 22. The ends of the arms of the U are adapted to carry studs or lugs 26 and 27 which project outwards from the U at right angles to the arms 22 and 23 in a direction parallel to the base 22.

With the exception of the hinge-pin 21, the assembly formed by the elements of the latch 20 is made of plastic, for example, having a suitable thickness for obtaining good mechanical resistance to the stresses applied by the strap by means of the hinge-pin 21 while permitting displacement of the ends of the lateral arms 23 and 24 at the level of the lugs 26 and 27. It is noted that the spacer member 25 has the shape of the letter V, the point 28 of which is directed towards the interior of the arms 23 and 24 whilst the points 29 and 30 are rigidly fixed to the ends of said arms.

By way of example, the hinge-pin 21 is designed in the form of a stainless steel rod which is maintained within two bores pierced in the arms 23 and 24. One end of the rod or pin 21 terminates in a head whilst the other end is threaded so as to cooperate by screwing with one of the two bores which is internally threaded. The head of the rod is a milled screw-head, for example, thus making it possible to screw the rod 21 into the internally-threaded bore by means of a screwdriver.

As shown in FIG. 4, the base 22 is so shaped as to provide a bearing face having a boss 66, the function of which will be explained hereinafter.

The latch 20 which has just been described is adapted to cooperate with the locking body 10. To this end, said body is provided with a sole-plate 34 of rectangular shape, the long sides of which are flanked by cheeks or side-plates 35 and 36 having a height which is greater than the thickness of the sole-plate 34. Each cheek is pierced at one end with an orifice 37 and 38 in which the lugs 26 and 27 of the latch are intended to engage so as to permit rotation of this latter about the axis formed by the lugs 26 and 27. This explains the presence of the spacer member 25 as well as the elasticity of this latter and of the arms 23 and 24. It is thus possible to place the latch 20 in position on the locking body 10 while at the same time, as will be explained hereinafter, permitting escape or withdrawal of said latch from the locking body when efforts having predetermined directions are applied on the hoop by the user's foot.

The sole-plate 34 is provided with orifices as designated by the reference 39 in order to fix said sole-plate on the sailboard by means of a screw as designated by the reference 40.

Between the cheeks 35 and 36, the sole-plate 34 serves as a support for a locking device proper for the latch 20. Said device includes a heel 41 placed next to the orifices 37 and 38 and rigidly fixed to the sole-plate. Said heel 41 extends over a predetermined length of the sole-plate and has two cavities 52 and 53. The cavity 52 serves as a housing for a shaft 42 which is secured against rotation and associated with a knurled wheel 43 which is secured against translation. One end 44 of the shaft 42 is square and is supported by a square-section recess 46 which performs the function of locking of the shaft whilst the other end is supported by a cylindrical bore 45 which performs the function of bearing. Said shaft 42 is provided with a screw-thread which cooperates with the internally-threaded orifice of the knurled wheel 43. Said knurled wheel 43 is therefore capable of rotating about the shaft. Rotation of the wheel is obtained by the fact that its external periphery is accessible externally of the heel 41 by means of an opening 47 formed on the side remote from the sole-plate. It is apparent that said sole-plate is provided with a housing 48 for the periphery of the knurled wheel 43. This arrangement of knurled wheel and shaft permits longitudinal displacement of the shaft 42 in one direction or in another as indicated by the double arrow 49.

In order to mount the shaft 42 in the knurled wheel 43, arrangements are made to form an opening in the rear end of the heel 41 and to close this opening with an end-cap 71. The end-cap 71 is fixed on the heel 41 by means of a screw 72.

The cavity 53 serves as a housing for a spring 50 which cooperates at one end with the shaft 42 and at the other end with a substantially rectangular plate 51 having special cut-out portions and a special shape. On the side nearest the heel 41, said plate 51 is cut-out so as to form three tongues, namely a central tongue 54 and two lateral tongues 55 and 56. The central tongue penetrates into the housing 53 through a slot 57 of the heel 41 and the end portion of said tongue is adapted to cooperate with the spring 50. The slots 58 and 59 between the central tongue 54 and the lateral tongues 55 and 56 correspond to the thickness of the lateral walls of the heel 41, thus permitting displacements of the plate 51 in the directions represented by the double arrow 49. The ends of the lateral tongues 55 and 56 are bent downwards in the direction of the sole-plate and these bent-back ends 60 and 61 are housed within recesses of the sole-plate such as the recess designated by the reference 61A.

The end portion 62 of the plate 51 opposite to the end which carries the tongues 54, 55 and 56 is bent upwards and said bent end portion 62 has a suitable shape, especially a hollow end face 73 in order to cooperate with the base 22 (boss 66) of the latch 20 so as to achieve snap-action engagement of the latch on the end portion 62 and locking of the latch against this latter in the closed position. The plate 51 is maintained in position against the sole-plate 34 by means of bosses 63 and 64 carried by the cheeks 35 and 36 and a groove is formed in said bosses for displacement of the plate 51 in sliding motion. The sliding distance is limited by the length of the recesses 61A provided for the downwardly-bent ends 60 and 61 of the tongues 55 and 56. This length of the sole-plate recesses is distinctly shorter than that shown in FIG. 5 in order to permit adjustment of the stiffness of snap-action engagement and therefore of unlocking of the latch.

It will be noted that the plate 51 has a central opening so as to permit access to the head of the fixing screw 40.

The operation of the safety device for the foot-holder of a sailboard or the like is accordingly as follows. By drawing together the arms 23 and 24 of the latch 20, the lugs 26 and 27 are engaged in the holes 37 and 38 of the cheeks 35 and 36, whereupon the hoop of the foot-holder has the position shown in FIG. 2. By moving the latch 20 downwards in the direction of the arrow 65, the boss 66 of the base 22 comes into contact with the bent-back end portion 62 of the plate 51. By forcing this movement, the plate 51 has a tendency to move towards the heel 41 against the action of the spring 50 which works in compression, thus permitting snap-action engagement of the latch on the bent-back end 62 and locking in position. In FIG. 4, there are shown three positions of the latch, namely an open position A, a position B during snap-action engagement and a locking position C. There are also shown two positions of the bent-back end portion 62 of the plate 51 : one position D corresponds to position B of the latch and the other position E corresponds to the locking position C.

In the locking position, stiffness of locking can be adjusted by rotating the knurled wheel 43 in one direction or in another in accordance with the indications + and − marked on the heel 41 in proximity to the knurled wheel. As will be readily apparent, the degree of stiffness can also be adjusted prior to snap-on engagement of the latch.

When positioning and adjustment of the different foot-holders have been completed, the sail-board is then ready for use. In the event of excessive pulling efforts exerted by the feet on the hoop at right angles to the sailboard, a force is applied to the hinge-pin 21 of the latch in the direction of opening. If the component of this force along the axis of the spring 50 is higher than the locking force of this latter, the plate 51 moves towards the heel while compressing the spring, thus releasing the boss 66 together with the latch 20. As a result, the hoop of the foot-holder is no longer stretched and permits disengagement of the user's foot.

In the event that these efforts are also exerted or exerted only in a direction parallel to the sailboard, a component is exerted at right angles to the arms 23 and 24 of the latch in one direction or in the other, thus reducing the width of opening between said arms. This has the effect of releasing one of the lugs 26 or 27 from its housing and consequently of freeing the latch from the locking body 10. The hoop of the foot-holder therefore opens completely and no longer holds the user's foot in position.

The example of construction of the safety device for the foot-holder of a sailboard which has just been described with reference to FIGS. 2 to 5 is not provided with means for adjusting the length of the hoop in order to adapt it to the dimensions of the feet of different sailboard users. This adjustment may be performed in different ways, one of which will now be described with reference to FIG. 6.

In FIG. 6, the strap 8 at the latch end is provided on each side with a so-called Velcro fastening strip 67 and 68 whilst the strands 12 and 13 of the portion of strap which is attached to the loop 9 are not stitched together over a certain length so as to permit separation of the strands, the opposite faces of which are also provided with Velcro fastening strips 69 and 70. The hoop is formed by pressing the strands 12 and 13 against the strap 8. The length of the hoop can be varied at will by varying the relative position of the strands 12 and 13 and of the strap 8. It is clear that the assembly formed by Velcro fastening strips must have a resistance to opening of the hoop which is greater than that obtained by means of the safety device in accordance with the invention.

What is claimed is:

1. A safety device for the foot-holder of a sailboard or the like in which said foot-holder has a strap in the form of a loop fixed at one end on the sailboard, wherein the other end of the strap is secured to a latch which can be engaged in a locking body with a first elasticity in a first predetermined direction and then locked in said locking body with a second elasticity in a second direction perpendicular to the first predetermined direction, said latch and locking body being so arranged that under the action of a pulling stress exerted on the latch in the second direction, said latch is unlocked in a direction to enlarge said loop while remaining engaged in the locking body and that under the action of a shearing stress exerted on the latch in the first direction, said latch is released from the locking body and opens the hoop.

2. A safety device according to claim 1, wherein the latch comprises means for resiliently engaging the locking body and wherein said locking body is provided with means for resiliently locking said latch.

3. A safety device according to claim 2, wherein the locking body is provided in addition with means for adjusting the second elasticity.

4. A safety device according to claim 2, wherein the means for resilient engagement of the latch include two parallel arms, the ends of which on one side are maintained in rigidly fixed relation to each other whilst the other two ends are maintained in resilient relation to each other and are provided with means for engagement of the locking body.

5. A safety device according to claim 4, wherein the means for engagement of the locking body include lugs adapted to cooperate with orifices carried by the locking body.

6. A safety device according to claim 4, wherein the means for obtaining the first elasticity include the parallel arms associated with resilient spacing means disposed between said arms.

7. A safety device according to claim 6, wherein the resilient spacing means include a spacer member having the shape of the letter V, the ends of which are rigidly fixed to the parallel arms.

8. A safety device according to claim 2, wherein the means for resiliently locking said latch include an element which is capable of displacement in sliding motion over a predetermined distance and a spring adapted to cooperate with said sliding element so as to maintain said element in a predetermined position.

9. A safety device according to claim 8, wherein the sliding element is provided at one end opposite to the end subjected to the action of the spring with a bearing face on which a corresponding bearing face of the latch is intended to be locked in position.

10. A safety device according to claim 9, wherein the bearing faces of the sliding element and of the latch are shaped so as to permit locking and unlocking by relative sliding motion of the bearing faces

11. A safety device according to claim 8, wherein the means for adjusting the second elasticity include a knurled wheel associated with a threaded shaft, said shaft being secured against rotation whilst the knurled wheel is secured against translation, one end of said shaft being adapted to cooperate with said spring so that rotation of the knurled wheel produces displacement of the shaft and compresses said spring to a greater or lesser extent.

12. A safety device according to claim 8, wherein the sliding element is provided with means for limiting the length of its displacement.

13. A safety device according to claim 12, wherein the means for limiting the length of displacement of the sliding element include at least one lug carried by said sliding element, said lug being adapted to cooperate with a recess formed in the locking body.

* * * * *